US006341948B2

(12) United States Patent
Dewhirst et al.

(10) Patent No.: US 6,341,948 B2
(45) **Date of Patent: *Jan. 29, 2002**

(54) INTERNAL OIL FILTER ELEMENT FOR REFRIGERATION COMPRESSOR

(75) Inventors: Randy E. Dewhirst, Onalaska, WI (US); James W. Noben, Dakota, MN (US)

(73) Assignee: American Standard International Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/731,181

(22) Filed: Dec. 7, 2000

Related U.S. Application Data

(62) Division of application No. 09/204,868, filed on Dec. 3, 1998.

(51) Int. Cl.[7] ..... F04B 39/00; F04B 53/00

(52) U.S. Cl. ..... 417/312; 277/412

(58) Field of Search ..... 62/192, 292, 324.1, 62/468; 277/18; 418/84, 97, 312; 184/6.16

(56) References Cited

U.S. PATENT DOCUMENTS

| | | | | |
|---|---|---|---|---|
| 4,741,177 A | | 5/1988 | Glanvall | 62/470 |
| 4,788,825 A | | 12/1988 | Calupca et al. | 62/84 |
| 4,938,664 A | | 7/1990 | Zinsmeyer | 417/83 |
| 5,159,820 A | | 11/1992 | Ohishi et al. | 62/468 |
| 5,301,771 A | | 4/1994 | Sishtla et al. | 184/6.16 |
| 5,404,964 A | | 4/1995 | Zinsmeyer et al. | 184/6.12 |
| 5,562,427 A | | 10/1996 | Mangyo et al. | 417/313 |
| 5,685,699 A | | 11/1997 | Holmes et al. | 417/423.1 |
| 6,206,653 B1 | * | 3/2001 | Dewhirst et al. | 417/312 |

* cited by examiner

*Primary Examiner*—Teresa Walberg
*Assistant Examiner*—Leonid M Fastovsky
(74) *Attorney, Agent, or Firm*—William J. Beres; William O'Driscoll

(57) ABSTRACT

A refrigeration unit having a compressor that includes a cast member, a cavity formed in the cast member, and an oil filter element dividing the cavity into an inlet cavity and an outlet cavity. An inlet port for directing the unfiltered oil into the inlet cavity and an outlet port for directing filtered oil out of the outlet cavity are also included. The filter element is secured in the cavity between an integral plate on one end and ears on the opposite end. A seal between the cast member and the removable cover is included. Also included is another seal positioned between the inlet and outlet cavities. The filter element may be cylindrical. At least one isolation valve that prevents or allows flow into and out of the filter cavity may be included. The inlet port may be formed in the cast member and the outlet port may be formed in the removable cover, or vice versa. At least one lubrication point and an oil conduit communicating between the lubrication port and the outlet port are included.

17 Claims, 3 Drawing Sheets

INTERNAL OIL FILTER ELEMENT FOR REFRIGERATION COMPRESSOR

This application is a divisional of Ser. No. 09/204,868 filed on Dec. 3, 1998.

BACKGROUND OF THE INVENTION

The present invention relates to a refrigeration compressor having an oil filter. In particular, the present invention is directed to the placement of the oil filter within the body of the compressor.

A refrigeration compressor is an integral part of a refrigeration unit, along with an evaporator, expansion valve, and condenser. A compressor compresses the refrigerant, thus raising its temperature. This compressed refrigerant gas then enters the condenser and is condensed into liquid form by contacting it with another cooler medium, such as ambient air, ground water, or water from a cooling tower loop. After the heat is removed from the refrigerant in the condenser, the condensed refrigerant liquid goes to an expansion valve. The expansion valve allows a limited quantity of liquid refrigerant to enter the evaporator, while maintaining the pressure difference between the condenser (at higher pressure) and the evaporator (at lower pressure). The liquid refrigerant entering the evaporator evaporates after contacting a heat load, such as the refrigerator interior or ventilation air that is to be cooled, thus absorbing heat from the heat load. The refrigerant vapor leaves the evaporator and returns to the compressor to repeat the cycle.

A refrigeration compressor commonly has a cast metal housing and a need for lubrication of the moving parts, such as the gears and bearings. A refrigeration compressor contains an oil sump where lubricating oil collects and a lubrication system to direct oil from the sump to each lubrication point. The oil lubrication system has an oil filter for removing particulate matter from lubrication oil.

The oil filter associated with a refrigeration compressor has been provided in a separate pressure vessel attached onto the outside of the compressor, or even contained in a separate pressure vessel unattached to the compressor body.

Having a separate pressure vessel increases the potential for oil leaks. In addition, an oil filter attached to the housing of a compressor is not easily replaced. In many refrigeration compressors in the prior art it is quite difficult to replace the oil filter without losing the charge of refrigerant. Another problem with prior art refrigeration compressors and their separate oil filters is that the oil filter element itself gets contaminated quite easily, and this greatly reduces its filtering efficiency. External oil filters also make it more difficult for clean, filtered oil to reach the lubrication points, since the oil has to travel farther (and thus pick up more impurities) to get to its targets. In addition, an oil filter vessel projecting from the compressor is exposed and subject to injury, particularly when the compressor is being shipped and installed.

U.S. Pat. No. 5,159,820 discloses an oil separator integrally mounted on a compressor. In this patent, elements that separate the refrigerant from the oil and then filter the oil are attached to the compressor casting and operatively connected to the compressor. This reference, however, does not disclose an oil filter located inside of the compressor casting.

BRIEF SUMMARY OF THE INVENTION

An object of the invention is to provide an oil filtration system having fewer leak points.

A further object of the invention is to enable the filter element to be replaced while the compressor is charged with refrigerant.

Another object of the invention is to allow cleaner oil to reach the lubrication points in the compressor.

Still another object of the invention is to provide an oil filter which does not project outward from the compressor.

To achieve at least one of the objects at least in part, and in accordance with the purpose of the invention, as embodied and broadly described herein, the refrigeration compressor of the present invention includes a cast member and a cavity formed in that cast member. The cavity is divided into an inlet cavity and outlet cavity by a filter element. The compressor also includes an inlet port for directing unfiltered oil into the inlet cavity and an outlet port for directing clean oil away from the outlet cavity.

Two advantages of this invention are that the possibility of oil leaks is reduced and cleaner oil reaches the lubrication points in the compressor. A further advantage of this internal oil filter is to allow easy replacement of the inexpensive filter element (as opposed to the whole oil filter vessel) while the compressor is charged with refrigerant. A further advantage of this invention is to minimize the possibility that the filter vessel will be damaged during shipping or installation of the compressor.

Additional objects and advantages of the invention will be set forth in part in the description that follows, and in part will be obvious from the description, or may be learned by practice of the invention. The objects and advantages of the invention will be realized and attained by means of the elements and combinations particularly pointed out in the appended claims.

The present invention provides a refrigeration compressor. The compressor comprises a cast member with a cavity formed in the cast member. An oil filter element divides the cavity into an inlet cavity and an outlet cavity. The cavity includes an inlet port for directing oil to be filtered into the inlet cavity, and an outlet port for directing filtered oil out of the outlet cavity.

The present invention also provides a gear driven refrigerant compressor. The compressor comprises: a housing; a low speed drive shaft with an integrally mounted bull gear; and a pinion drive shaft with a pinion drive gear engaging the bull gear, all located in an upper region of the housing. The compressor also includes an oil sump located in a lower region of the housing; and an oil filter cavity formed in an intermediate region of the housing between the upper region and the lower region, the cavity containing an oil filter.

The present invention further provides that the oil filter include at least one end cap having eared elements where the eared elements act as a spacer between the cavity and the oil filter.

It is to be understood that both the foregoing general description and the following detailed description are exemplary and explanatory only and are not restrictive of the invention as claimed.

The accompanying drawings, which are incorporated in and constitute a part of this specification, illustrate embodiments of the invention and together with the description, serve to explain the principles of the invention.

DETAILED DESCRIPTION OF THE INVENTION

Reference will now be made in detail to the embodiment of the invention illustrated in the accompanying drawings. The same reference numbers will be used throughout the drawings to refer to the same or like parts.

While the invention will be described in connection with one or more embodiments, it will be understood that the invention is not limited to these embodiments. On the contrary, the invention includes all alternatives, modifications, and equivalents as may be included within the spirit and scope of the appended claims.

Figure 1:
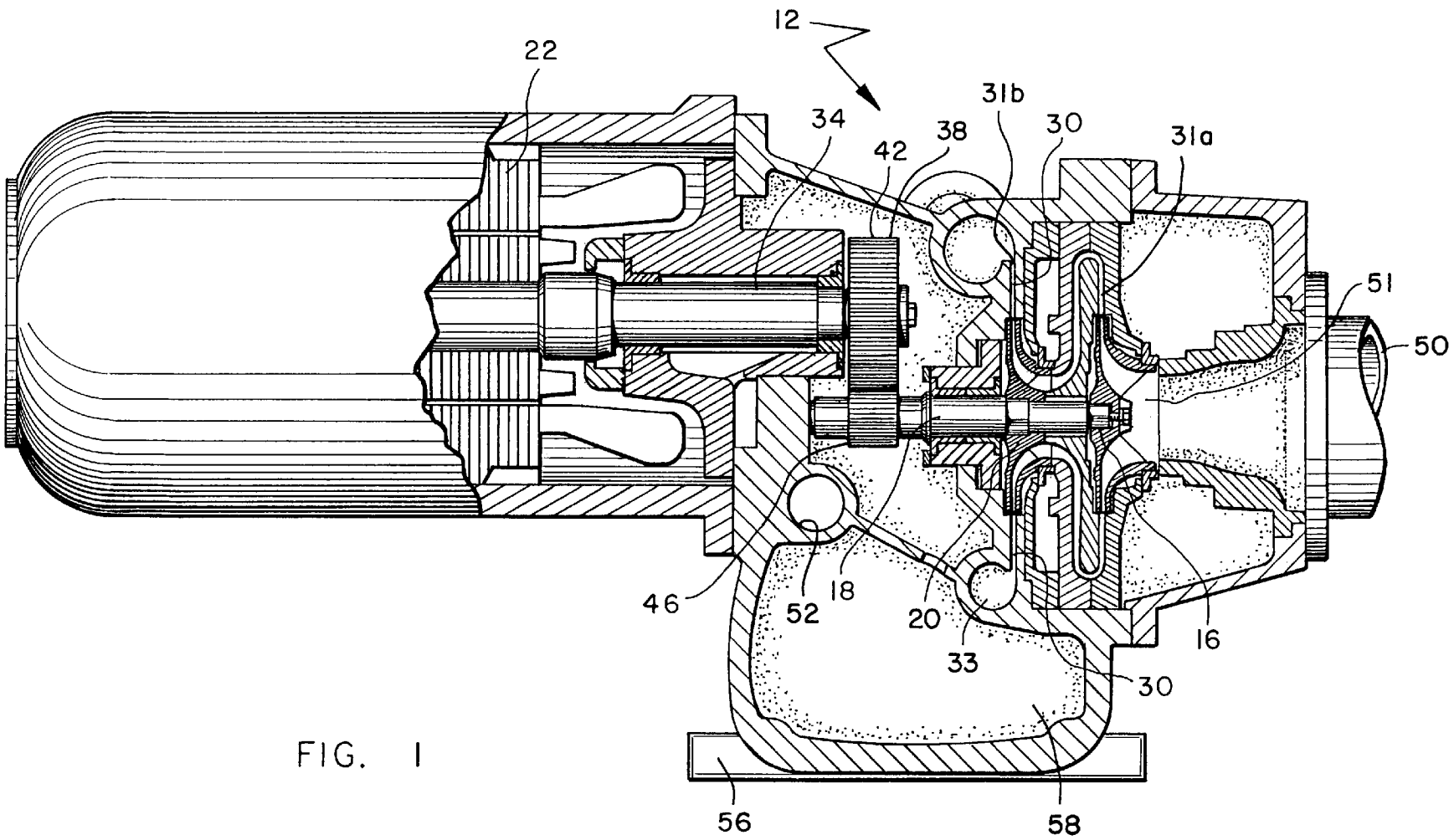
FIG. 1 is a side elevation of the invention, cut away and drawn partially in section to show the interior features.

FIG. 1 depicts a gear-driven refrigeration compressor 12 that includes impellers 16 and 20 carried on a pinion drive shaft 18 and a motor 22 to drive the pinion drive shaft 18. The compressor 12 has a refrigerant gas inlet 51 and internal passages 30 directing refrigerant gas into and through the impellers 16 and 20.

The motor 22 drives a low-speed output shaft 34. A bull gear 38 is attached to the low speed shaft 34, and drives the pinion gear 46 which is integral with the pinion drive shaft 18. A direct drive compressor (not illustrated) would have the motor 22 directly attached to the pinion drive shaft 18 that drives the impellers 16 and 20.

A conduit 50 from the evaporator (not shown) feeds refrigerant vapor to the gas inlet 51. The internal passages 30 include circular diffuser passages 31*a*, 31*b* and a gas collecting space known as a volute 33 at the perimeter of the compressor 12. In operation, hot refrigerant vapor enters the gas inlet 51 from the piping conduit 50 and flows to the first impeller 16. Once the gas is inside the rotating first impeller 16, this rotation accelerates the gas radially outward. In a multi-stage compressor 12, the compressed gas is guided by the internal passage 30 from the first impeller 16 into the second impeller 20 where the gas is again radially accelerated.

The gas exits the second impeller 20 into a circular diffuser passage 31*b* and then into the volute 33 at the perimeter of the compressor 12. As the gas flows to the volute 33, the volume of the passages available for gas flow increases, thereby reducing the velocity of the gas flow. The pressure of the gas is increased as it travels through and around the impellers 16, 20. Eventually, the gas has reached the desired compression ratio and is directed out of the compressor 12 to a condenser (not shown).

A cast member 56 defines a housing for the refrigerant compressor 12. An oil filter cavity 52 is shown cast in the cast member 56, preferably between the oil sump 58 and the compressor lubrication points, these lubrication points including the gears 42, 46 and the various bearings for the shafts 18, 34.

Figure 2:
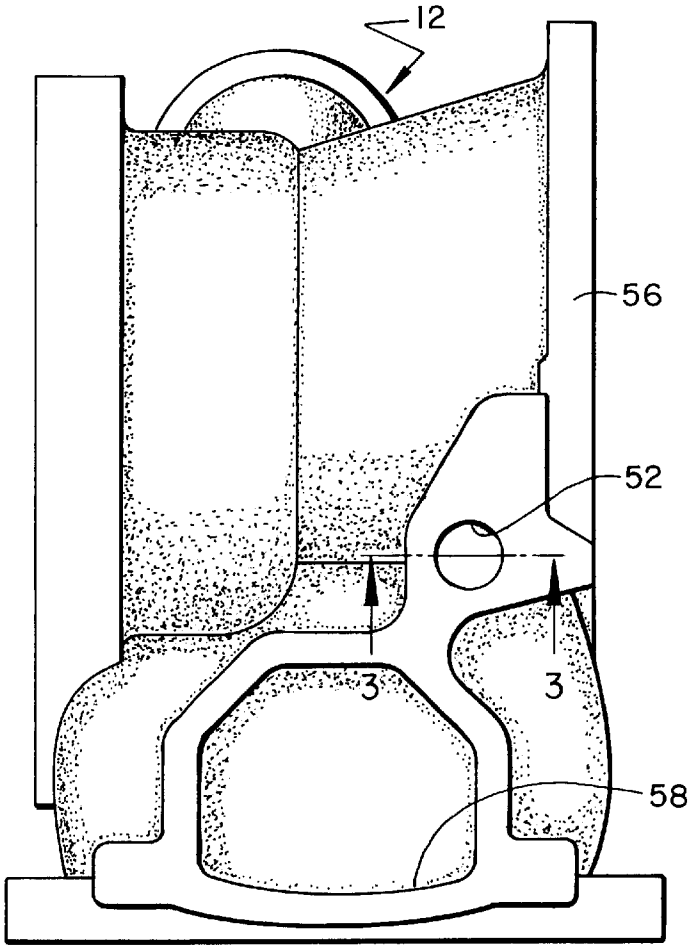
FIG. 2 is a side elevation view showing the opposite side of the refrigeration compressor compared to FIG. 1, and specifically showing the oil filter cavity.

FIG. 2 is an elevation of the opposite side of the refrigeration compressor 12 showing the oil filter cavity 52 (also visible in FIG. 3) cast into the cast member 56, and an oil sump 58.

Figure 3:
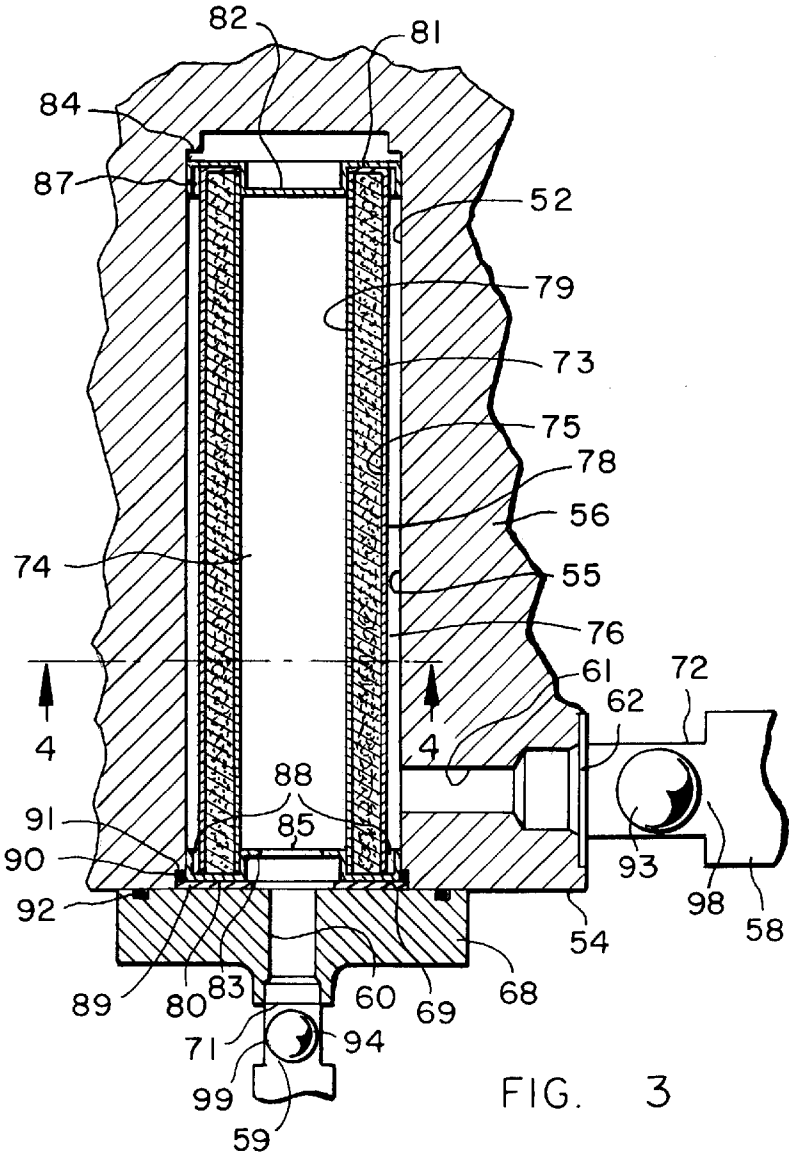
FIG. 3 is a fragmentary cross-section, taken along line 3—3 in FIG. 2, depicting the inside of the oil filter cavity.

FIG. 3 shows more details of the filter cavity 52 in the cast member 56. The filter cavity 52 is a recess in the outer surface 54 of the cast member 56 having a generally cylindrical wall 55. The generally cylindrical wall 55 can be non-cylindrical without departing from the present invention.

The filter cavity 52 can be formed by providing a core in the mold in which the cast member 56 is formed. Alternatively, the cavity 52 can be machined or otherwise formed. The filter cavity 52 has an inlet port 61 communicating from the outer surface 54 of the casting 56 to the filter cavity 52. The inlet port 61 is provided with a socket recess 62 to receive a suitable conduit 72 communicating with the oil sump 58 and an oil pump (not shown). The filter cavity 52 also includes steps 84 and 91.

A removable filter cover 68 having a bearing surface 69 is fastened to the outer surface 54 of the casting 56 to cover the filter cavity 52. Screws or other fasteners (not shown) providing access to the filter cavity 52 are suitable. The filter cover 68 has an outlet port 60 communicating with filtered oil in an outlet cavity 74 and having a socket recess 71 to receive a suitable conduit 59 communicating with one or more lubrication points such as the bull gear 38 shown in FIG. 2.

Figure 4:
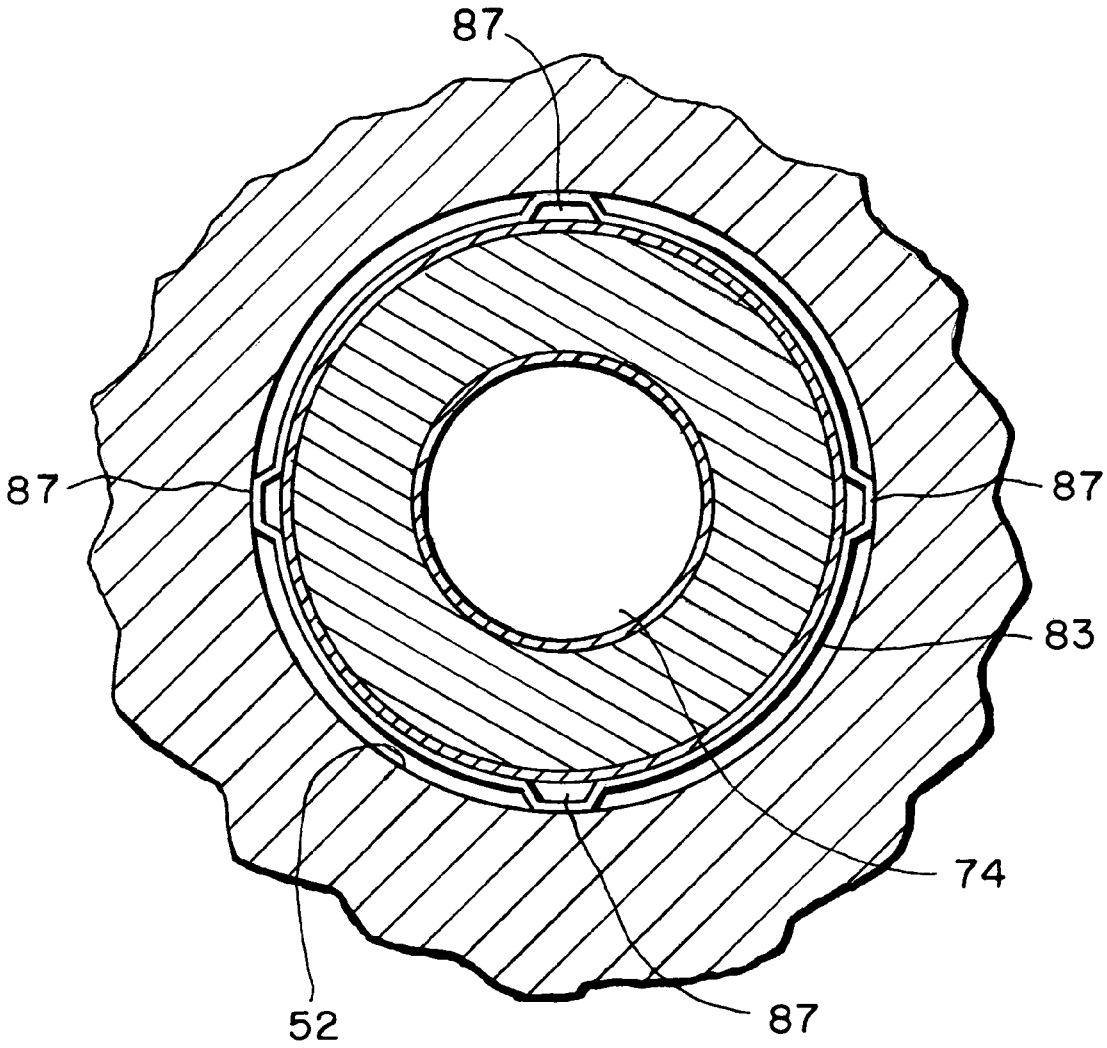
FIG. 4 is an isolated side elevation of an end cap 83 taken along line 4—4 of FIG. 3.

An oil filter element 73 is located within the filter cavity 52. The filter element 73 is a tubular member made of a suitable filtering material. The filter cavity 52 is divided by the filter element 73 into an inlet cavity 76 communicating with the inlet port 61 and the outlet cavity 74 communicating with the outlet port 60. The filter element 73 has an outer perforated metal jacket 75, an inner perforated metal jacket 79 defining a hollow interior, and first and second ends 80 and 81. The filter element 73 includes end caps 82 and 83. The end cap 82 is closed, thus allowing no oil to bypass the second end 81. As shown in FIG. 4, the end cap 83 has a hole 85 in it to allow filtered oil to escape the filter element 73 through the outlet port 60. The end caps 82 and 83 have ears 87 and 88, respectively, as shown in FIG. 4.

As shown in FIG. 3, an integral plate 89 is part of the first end 80 of the filter element 73. The ears 87 and 88 bear against the sides of the filter cavity 52 thus entering the filter element 73. An o-ring or other suitable sealing element 90 is provided to seal between the inlet cavity 76 and the outlet cavity 74. The integral plate 89 bears against and compresses the o-ring 90 against the step 91 in the filter cavity 52. The integral plate 89, and thus the entire filter element 73, is held in pace between the filter cover 68 and the o-ring or other sealing element 90. The filter cover 68 bears against an additional o-ring or other suitable sealing element 92 between the filter cover 68 and the surface 54 to seal the filter cavity 52 with respect to ambient air. Isolation valves 93 and 94 are provided to prevent or allow flow through the inlet port 61 and outlet port 60, respectively.

As shown in FIG. 3, during normal operation the unfiltered oil enters the inlet cavity 76 through the inlet port 61. The entering oil circulates in the inlet cavity 76 around the outside of the filter element 73. As the oil passes through the filter element 73, the oil is filtered and then passes to the outlet cavity 74, then through the outlet port 60. The sealing element 90 prevents oil from bypassing the filter element 73 from the inlet cavity 76 directly to the outlet cavity 74. During normal operation, the isolation valves 93 and 94 are opened to allow flow through the inlet port 61 and outlet port 60, respectively.

When the filter element 73 is to be inspected, serviced, replaced or accessed for some other reason, the isolation valves 93 and 94 are closed. This isolates the filter cavity 52 from the rest of the lubrication system. The filter cover 68 can then be removed without losing oil or pressure in other parts of the lubrication or refrigerant system, and access to the filter element 73 is provided. If the element 73 is to be replaced, for example, it can readily be slid out of the cavity 52 and replaced by another filter element such as 73. After access to the filter cavity 52 is no longer necessary, the filter cover 68 is fastened in place and the isolation valves 93 and 94 are re-opened to restore flow. Make-up oil can be added conventionally to replace any oil lost when the filter element 73 is removed.

Two advantages of this invention are that the possibility of oil leaks is reduced and cleaner oil reaches the lubrication points in the compressor. A further advantage of this internal oil filter is to allow easy replacement of the inexpensive filter element (as opposed to the whole oil filter vessel) while the compressor is charged with refrigerant. A further advantage of this invention is to minimize the possibility that the filter vessel will be damaged during shipping or installation of the compressor.

The invention has been shown and described in preferred form only, and by way of example, and many variations may be made in the invention that will still be within the spirit of the invention. It is understood, therefore, that the invention is not limited to any specific embodiment except insofar as such limitations are included in the appended claims.

Other embodiments of the invention will be obvious to those skilled in the art from consideration of the specification and practice of the invention disclosed herein. It is intended that the specification and examples be considered as exemplary only, with a true scope and spirit of the invention being indicated by the following claims.

We claim:

1. A refrigeration compressor comprising a cast member, a cavity formed in said cast member, an oil filter element dividing said cavity into an inlet cavity and an outlet cavity, an inlet port for directing oil to be filtered into said inlet cavity, and an outlet port for directing filtered oil out of said outlet cavity.

2. A refrigeration compressor according to claim 1 wherein said filter element is secured in said cavity.

3. A refrigeration compressor according to claim 1 further comprising a removable cover over said inlet and outlet cavities.

4. A refrigeration compressor according to claim 3, further comprising ears and an integral plate in said cavity, said oil filter element being secured between said integral plate and said ears.

5. A refrigerant compressor according to claim 4 wherein the ears act as spacers between the oil filter element and the cavity.

6. A refrigeration compressor according to claim 3 further comprising a seal between said cover and said cast member.

7. A refrigeration compressor according to claim 1 wherein said oil is filter element is cylindrical.

8. A refrigeration compressor according to claim 1 further comprising a seal positioned to seal between said inlet cavity and said outlet cavity.

9. A refrigeration compressor according to claim 1 further comprising at least one refrigerant passage, an oil sump communicating with said passage, and at least one isolation valve which prevents or allows the oil flow into and out of said filter cavity to allow for the replacement of said filter element while said refrigeration compressor is charged with refrigerant.

10. A refrigeration compressor according to claim 1, wherein one of said inlet port and said outlet port is a port in the cast member wall and the other of said inlet port and said outlet port is a port in said removable cover.

11. A refrigeration compressor according to claim 1 further comprising at least one lubrication point and an oil conduit communicating between said lubrication point and said outlet port.

12. A refrigerant compressor comprising:

a cast member;

a cavity formed in said cast member;

an oil filter element dividing said cavity into an inlet cavity and an outlet cavity wherein said oil filter element is secured in said cavity;

an inlet port for directing oil to be filtered into said inlet cavity;

an outlet port for directing filtered oil out of said outlet cavity;

a removable cover over said inlet and said outlet cavities; and ears and an integral plate in said cavity, said oil filter element being secured between said integral plate and said ears wherein the ears act as spacers between the oil filter element and the cavity.

13. The refrigeration compressor of claim 12 further including a seal between said cover and said cast member.

14. The refrigeration compressor according to claim 13 wherein the oil filter element is cylindrical.

15. The refrigeration compressor according to claim 12 further including at least one refrigerant passage, an oil sump communicating with the passage, and at least one isolation valve which prevents or allows oil flow into or out of said filter cavity to allow for the replacement of said filter element while said refrigeration compressor is charged with refrigerant.

16. The refrigeration compressor according to claim 15 wherein one of said inlet port and said outlet port is board in the cast wall member and the other of said inlet port and said outlet port is a port in the cast wall member and the other of said inlet port and said outlet port is a port in said removable cover.

17. A refrigerant compressor comprising:

a cast member;

a cavity formed in said cast member;

an oil filter element dividing said cavity into an inlet cavity and an outlet cavity wherein said oil filter element is secured in said cavity;

an inlet port for directing oil to be filtered into said inlet cavity;

an outlet port for directing filtered oil out of said outlet cavity;

a removable cover over said inlet and said outlet cavities;

ears and an integral plate in said cavity, said oil filter element being secured between said integral plate and said ears wherein the ears act as spacers between the oil filter element and the cavity;

at least one refrigerant passage;

an oil sump communicating with the passage; and at least one isolation valve which prevents or allows oil flow into or out of said filter cavity to allow for the replacement of said filter element while said refrigeration compressor is charged with refrigerant, wherein one of said inlet port and said outlet port is bored in the cast wall member and the other of said inlet port and said outlet port is a port in the cast wall member and the other of said inlet port and said outlet port is a port in said removable cover.

* * * * *

UNITED STATES PATENT AND TRADEMARK OFFICE

CERTIFICATE OF CORRECTION

PATENT NO. : 6,341,948
DATED : January 29, 2002
INVENTOR(S) : Randy E. Dewhirst and James W. Noben It is certified that error appears in the above-identified patent and that said Letters Patent is hereby corrected as shown below:

Column 5,
Line 53, delete the first occurrence of [is].

Signed and Sealed this

Twenty-first Day of May, 2002

*Attest:*

*Attesting Officer*

JAMES E. ROGAN
*Director of the United States Patent and Trademark Office*